US009249544B2

(12) United States Patent
Caputo

(10) Patent No.: US 9,249,544 B2
(45) Date of Patent: Feb. 2, 2016

(54) ROAD FINISHER, SCREED PLATE, AND TAMPER BAR COMPRISING A HEATING ELEMENT AND METHOD TO MANUFACTURE THE SAME

(71) Applicant: BOMAG GmbH, Boppard (DE)

(72) Inventor: Gianluca Caputo, Castenaso (IT)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/448,704

(22) Filed: Jul. 31, 2014

(65) Prior Publication Data

US 2015/0037097 A1 Feb. 5, 2015

(30) Foreign Application Priority Data

Jul. 31, 2013 (DE) ..... 10 2013 012 813

(51) Int. Cl.

| | |
|---|---|
| ***E01C 23/14*** | (2006.01) |
| ***E01C 19/30*** | (2006.01) |
| ***C23C 4/02*** | (2006.01) |
| ***C23C 4/12*** | (2006.01) |
| ***C23C 4/18*** | (2006.01) |
| ***E01C 19/48*** | (2006.01) |
| ***C23C 4/06*** | (2006.01) |
| ***C23C 4/08*** | (2006.01) |

(52) U.S. Cl.

CPC . *E01C 19/30* (2013.01); *C23C 4/02* (2013.01); *C23C 4/06* (2013.01); *C23C 4/08* (2013.01); *C23C 4/127* (2013.01); *C23C 4/18* (2013.01); *E01C 19/4833* (2013.01); *E01C 19/4873* (2013.01); *E01C 2301/10* (2013.01)

(58) Field of Classification Search

USPC ..... 404/95, 118; 219/553
IPC ..... E01C 23/14
See application file for complete search history.

(56) References Cited

U.S. PATENT DOCUMENTS 5,397,199 A * 3/1995 Frampton et al. ..... 404/118
5,417,516 A * 5/1995 Birtchet ..... 404/71

(Continued)

FOREIGN PATENT DOCUMENTS

| | | | |
|---|---|---|---|
| DE | 10 2005 018 062 | A1 | 12/2005 |
| EP | 1 416 090 | A2 | 5/2004 |
| WO | 2009/095146 | A1 | 8/2009 |

OTHER PUBLICATIONS

Espacenet, English Machine Translation of DE102005018062A1, published on Dec. 15, 2005, retrieved from http://worldwide.espacent.com on Jul. 31, 2014 (12 pages).

(Continued)

*Primary Examiner* — Gary Hartmann

(74) *Attorney, Agent, or Firm* — Wood, Herron & Evans, LLP

(57) ABSTRACT

The present invention relates to a road finisher comprising a screed plate and/or a tamper bar and also to a screed plate and/or tamper bar comprising a heating layer applied by thermal spraying.

17 Claims, 4 Drawing Sheets

(56) References Cited

U.S. PATENT DOCUMENTS

| | | | | |
|---|---|---|---|---|
| 5,889,261 | A * | 3/1999 | Boardman | 219/543 |
| 7,427,174 | B2 * | 9/2008 | Dearing | 404/95 |
| 7,919,730 | B2 * | 4/2011 | Shaw et al. | 219/466.1 |
| 2003/0066828 | A1 * | 4/2003 | Boardman | 219/543 |
| 2005/0257367 | A1 | 11/2005 | Cirri et al. | |
| 2010/0108661 | A1 * | 5/2010 | Vontell et al. | 219/477 |
| 2011/0002738 | A1 | 1/2011 | Mahler et al. | |
| 2011/0120987 | A1 * | 5/2011 | Abbott | 219/553 |
| 2013/0042465 | A1 * | 2/2013 | Esser et al. | 29/611 |

OTHER PUBLICATIONS

Espacenet, English Machine Translation of WO2009095146A1, published on Aug. 6, 2009, retrieved from http://worldwide.espacent.com on Jul. 31, 2014 (18 pages).

* cited by examiner

ROAD FINISHER, SCREED PLATE, AND TAMPER BAR COMPRISING A HEATING ELEMENT AND METHOD TO MANUFACTURE THE SAME

CROSS-REFERENCE TO RELATED APPLICATIONS

The present application claims priority under 35 U.S.C. §119 of German Patent Application No. 10 2013 012 813.7, filed Jul. 31, 2013, the disclosure of which is hereby incorporated herein by reference in its entirety.

FIELD OF THE INVENTION

The present invention relates to a road finisher comprising a screed plate and/or a tamper bar comprising a heating layer, and to a screed plate and a tamper bar each of which comprises a heating layer. The present invention further relates to a method to manufacture the screed and the tamper bar.

BACKGROUND OF THE INVENTION

Road finishers or asphalt finishers are construction machines used for producing asphalt surfaces. These construction machines are as well referred to as so-called pavers, especially wheel or track pavers. To this end, the road finisher distributes and smoothes bituminous paving material, and depending on the embodiment, also compacts the same. Such a road finisher is disclosed, for example, in WO 2009/095146 A1, the disclosure of which is incorporated herein by reference. Essential components of a generic road finisher are a bunker for the accommodation of the paving material, a transport unit, by means of which the paving material is transported to the paving site, a distributing device, by means of which the paving material is distributed across the width of the area to be paved, and a so-called paving screed, by means of which the ejected paving material is smoothed to obtain a homogeneous surface. The paving screed may include a number of functional units. Thus, apart from a screed plate that smoothes the paving material, the paving screed also frequently comprises a so-called tamper bar that performs the task, for example, of pre-compacting the paving material before it is smoothed down by the screed plate. The problem to be solved when laying paving materials is that of preventing, or at least reducing, the occurrence of sticking of the bituminous mixture to the respective paving devices as far as possible. To enlarge the paving screed, extendable screed extensions can be applied on both sides.

For this purpose, it is known from the prior art to heat particularly those contact surfaces of the tamper bar and/or the screed plate that are oriented towards the paving material. In addition to gas-powered heating devices, it has also proved to be particularly advantageous to use an electrical heating device for this purpose. Such an electrical heating device is frequently located in appropriate cavities inside the tamper bar and/or the screed plate, for example, in the form of a bar-shaped heating element, as specifically disclosed in WO 2009/095146 A1. The electrical heating device described therein is, however, relatively expensive in terms of production and maintenance. Furthermore, the obtained air gap results in inefficient heat transfer and a relatively long reaction time during the heating process. EP 1 416 090 A2 teaches adhesive bonding of heating elements to the paving screed. However, under the environmental conditions during operation, the organic materials used are apt to disintegrate and to release hazardous decomposition products. In addition, this arrangement requires a complex manual assembling procedure. Finally, the heating arrangement obtained is only of low mechanical resistance, and the heat transfer from the heating element to the screed plate is impaired by the used adhesives, so that, for example, the heating phase of the screed plate is still relatively long.

It is thus an object of the present invention to provide a road finisher, a screed plate, and a tamper bar that comprise an electrical heating device having an optimized construction while at the same time making it possible, in particular, to effect heating faster and more uniformly than heating devices known hitherto in the art.

SUMMARY OF THE INVENTION

Starting from a generic road finisher comprising a screed plate extending at right angles to the working direction of the road finisher and a tamper bar disposed rearwardly and/or forwardly of the screed plate in the working direction, and an electrical heating device comprising a power source, at least one electrically operated heating element electrically connected to the power source, and a switch gear unit for switching the at least one heating element on and off, which electrical heating device is configured to heat up a heating surface oriented towards the road subsurface, the essential basic concept of the present invention is that the heating element comprises a heating layer that has been applied to a substrate surface at least partially by thermal spraying.

Thus, unlike the prior art, the heating element is not inserted into appropriate cavities or holes produced by an expensive and complex procedure or applied by adhesive bonding, but is instead applied directly by thermal spraying to the surface of the relevant supporting element, more particularly, to the screed plate of the main screed and/or the screed extensions, if any, and/or the tamper bar. The term "paving screed" herein covers both the screed plate and the tamper bar. The screed plate is usually a smoothing element extending across the working width of the road finisher at right angles to the working direction and comprising a horizontal, downwardly oriented smoothing surface facing the paving material. The tamper bar is a beam-like compacting element that likewise extends longitudinally at right angles to the working direction and that is oriented towards the paving side such that it can carry out tamping movements in the vertical direction.

The surface coating method known as thermal spraying is defined as a standard in DIN EN 657 and is, in general, characterized by causing the coating materials to assume a partially or fully molten state inside or outside a flame sprayer and causing particles thereof to be accelerated in a gas stream and propelled towards the surface of the component to be coated. These methods are generally also referred to as thermal spray technology (TST). According to such methods, particles are applied to the surface of the component to be coated, said particles traveling at high velocities, more particularly, in the range of 50 m/s to more than 1000 m/s. The applied particles harden very rapidly and, in particular, by mechanical clamping, form a very stable connection with the component. Such coatings obtained by thermal spraying therefore are characterized by excellent bonding to the coated component, high mechanical resistance and a homogenous layer structure. Of the thermal spraying methods available, it is particularly preferred, according to one embodiment of the present invention, for the heating element to comprise a heating layer that has been applied to the substrate surface at least partially and preferably entirely by plasma spraying. As an alternative, use may be made of the so-called high velocity oxygen fuel spraying (HVOF) technology for at least partially applying the heating element. The thermal spraying techniques thus are coating processes in which molten (or heated) materials are sprayed onto a surface. The "feedstock" (coating precursor) is heated by electrical (plasma or arc) or chemical means (combustion flame). A spray torch (or spray gun) is the device performing the melting and acceleration of the particles to be deposited. Plasma spraying, as a subgroup of the thermal spraying methods, is characterized by causing melting to be effected by the high plasma temperature of a gas or gas mixture passing through a plasma torch, which gas or gas mixture has been guided through an arc and ionized. When hitting the surface to be coated, the particles flatten and harden, thus forming a very stable layer of a desired thickness on the surface to be coated. Thus, an essential basic concept of the present invention is the use of a heating layer obtained by means of thermal spraying for heating up the back side surfaces of the screed plate and/or the tamper bar opposite the surfaces that come into contact with the bituminous paving material. The term "substrate surface" refers to that surface of the respective component supporting the heating layer of the heating element to which the heating layer is applied. Thus, the term "heating layer" functionally refers to a coating by means of which a heating effect can be achieved. To this end, the heating layer is connected by suitable connecting means to the power source and can be switched on and off by means of the switch gear unit. The term "heating element" refers to the entire unit consisting of the heating layer and its connections to the power source. According to the present invention, the heating layer of the heating element is, at least in part and preferably entirely, obtained by thermal spraying onto the screed plate or the tamper bar. A heating layer obtained by thermal spraying is extremely resistant against mechanical stress and allows for optimized heat transfer to the screed plate or the tamper bar. As a result, for example, the initial heating phase of these elements can be reduced considerably, which in turn results in reduced fuel consumption and an increased efficiency of the road finisher. Additionally, the heating layer can easily be applied to three-dimensional substrate surfaces and/or to angled structures.

According to the present invention, the heating layer, preferably entirely obtained by thermal spraying, comprises several layers, more particularly, at least one sealing layer, at least one heat-up layer (hereafter also referred to as strip conductor) and at least one insulating layer. The strip conductor is the layer that is connected to the power source and that heats up when electric current is applied thereto. The sealing layer, by contrast, performs a protective function for the strip conductor and shields the same from the environment on that side of the heating element being opposite and facing away from the screed plate. The insulating layer electrically insulates the strip conductor, through which an electric current flows during the heating operation from the screed plate or the tamper bar. To this end, the insulating layer is located between the screed plate and the strip conductor. In order to ensure optimum heat transfer, the heating layer is preferably made of a material having excellent heat conducting properties. The, at least partial, use of alumina ($Al_2O_3$) based material has proved to be particularly suitable for this purpose.

In principle, the heating layer can comprise a plurality of single layers, and a heating layer comprising exactly three layers has proved to give optimum results in practical use. The heating layer provided in this embodiment consisting of three layers comprises an insulating layer located inwardly on the substrate surface, a strip conductor applied to the insulating layer, and a sealing layer forming the outside layer, which layers are applied in that same order to the screed plate and/or the tamper bar to obtain the heating layer. The insulating layer primarily serves the purpose of electrically insulating the strip conductor from the substrate, through which strip conductor electric current flows during the heating operation. Accordingly, the insulating layer is the first layer of the heating layer to be applied to the screed plate or the tamper bar.

The sealing layer preferably extends over the entire surface of the substrate and it ideally entirely covers the heating layer, with the exception of recesses which may be provided for electrical connections. While the thickness of the sealing layer may vary, it is preferably in the range of 0.1 mm to 0.3 mm, more preferably 0.2 mm. Preferably, the insulating layer also extends over the entire surface of the substrate. While the thickness of the insulating layer may likewise vary, it is preferably in the range of 0.2 to 0.6 mm, more preferably of 0.3 mm to 0.5 mm and most preferably 0.4 mm. The heat-up layer, by contrast, usually has a structured form and is embedded at least partially in the insulating layer and/or the sealing layer.

In terms of economic efficiency and work results, it has proved to be very advantageous to use alumina ($Al_2O_3$) based material for the insulating layer and/or the sealing layer. Thus, these two layers are preferably made of alumina based material. Preferably alumina is used in a purity degree of >99.5% mass per mass and even more preferably of >99.7% m/m. Specifically, the use of a mixture comprising 80% of $Al_2O_3$ and 20% of $Al_2O_3$+$TiO_2$ has proved to be particularly advantageous, the percentages given referring to mass per mass percentage (m/m). As an alternative, use may be made of an insulating layer and/or a sealing layer consisting entirely of $Al_2O_3$.

Likewise, a number of different materials can be used for the heat-up layer of the heating layer. However, nickel-chromium alloys are preferred, particularly those having a content of nickel of between 10% and 90% m/m and a content of chromium of from 90% to 10% m/m, and very preferably an alloy containing 80% m/m nickel and 20% m/m chromium. Further, more complex alloys may be preferred. Another alternative and preferred composition of the heating layer is a mixture comprising $Cr_3C_2$ (chromium carbide) and an NiCr alloy, more particularly, comprising 75% of $Cr_3C_2$ and 25% of an NiCr alloy, the percentages given referring to mass per mass percentage (m/m). This composition of the heat-up layer of the heating layer is advantageous in that heat-up layers of relatively great thickness can be obtained, for example, in the range of 0.2 mm to 0.5 mm. Further materials preferably used for obtaining the heating layer by thermal spraying are nickel (resulting in a practically self-controlling heating layer), substoichiometric titanium oxide, a complex alloy comprising NbSiB, an iron-chromium-aluminum alloy, and other carbides such as, in particular, WCo—NiCr.

As described above, the strip conductor preferably does not extend over the entire surface of the substrate. In order to achieve an optimum of fast and complete heating across the entire surface of the heating layer of the heating element, the strip conductor is preferably distributed in a meandrous fashion; that is to say, as an array of serpentine elements, across the heating surface. Basically, however, alternative configurations of the strip conductor are also possible in this context, for example, serrated and/or curved variants. Of course, it is also possible to provide a number of heat-up layers in a common heating layer or a common heating element, these being insulated from each other, and supplied with electric power, and also being capable of nesting with each other, for example.

The heating layer according to the present invention can basically be used at all those locations of a road finisher that come into contact with the bituminous paving material during the paving operation, or on the respective opposite sides of said locations. Thus, heating of these regions preferably occurs from that side of the respective component facing away from the paving material, so that the heating element and, in particular, the heat-up layer will not be in direct contact with the paving material. The underside of the screed plate is frequently formed by a smoothing plate, typically made of hardened and tempered steel. Finally, the screed plate is the element which ensures that a smooth paving surface is obtained by the road finisher. In order to prevent bituminous paving material on the paving surface from sticking to the screed plate, the heating layer of the present invention forms an optimal solution for heating up this region of the screed plate. The tamper bar makes it possible, for example, to pre compact the bituminous paving material before the screed plate smoothes down the same. Thus, the tamper bar is also regularly in contact with the bituminous paving material so that the application of the heating layer of the present invention to the tamper bar has likewise proved to be advantageous. The tamper bar is frequently configured to include a contact surface or a compacting ramp that slopes upwardly in a wedge-like manner in the working direction in order to render it capable of guiding the paving material towards the road subsurface. Thus, the heating layer may accordingly be disposed also in the vicinity of this wedge-like portion of the tamper bar extending obliquely upwardly.

When implementing the present invention in practice, it has proved to be preferable to apply the heating layer to the backside of the screed plate and/or the tamper bar over an intermediate anchor layer. Thus, the intermediate anchor layer is an intermediate layer disposed between the relevant substrate, i.e., the screed plate and/or the tamper bar, and the heating layer and it provides, for example, a particularly homogeneous surface for the application of the heating layer. The intermediate anchor layer is likewise preferably obtained by thermal spraying. The intermediate anchor layer is preferred to consist of a material having excellent heat conducting properties. Specifically, the use of an NiCoCrAlY alloy, i.e., an alloy comprising the elements nickel, cobalt, chromium, aluminum and yttrium, has proved to be particularly advantageous, which is accordingly preferred. The preferable thickness of such intermediate anchor layer is in the range of 0.02 mm to 0.05 mm and very preferably in the range of 0.03 mm to 0.04 mm.

An important advantage of the present invention is that the heating layer of the heating element can be applied to the required site with minimum space requirements and can furthermore be applied over the entire area thereof. The space required by the heating layer is extremely small. Furthermore, by applying the heating layer by way of thermal spraying, a heating layer of relatively high stability and resistance against mechanical stress can be obtained without laborious and time consuming adhesive bonding procedures. In addition, the aforementioned structure of the heating layer allows for especially rapid and homogenous heating of the paving screed and/or the tamper bar, thus reducing downtimes of the road finisher. According to the present invention, the heating layer including three layers preferably has a thickness of approximately 1 mm. The strip conductor is approx. 0.1 mm to 0.5 mm thick, more particularly, 0.2 mm.

In total, the heating layer thus consists exclusively of inorganic materials. The same applies to the intermediate anchor layer.

A further aspect of the present invention is a screed plate and/or a tamper bar each of which comprises a heating layer, as described above. Hardened steels, more particularly, Hardox steel, are especially suitable materials to be used for the screed plate and/or the tamper bar, onto which the heating layer will be applied by thermal spraying.

An essential feature of the present invention is, further, that the heating layer is obtainable by thermal spraying, more preferably by plasma spraying, or HVOF spraying, and very preferably exclusively by thermal spraying. This results in a heating element having a multi-layered heating layer, which heating layer comprises a heat-up layer on a substrate surface on the screed plate and/or the tamper bar and which, on the one hand, is characterized by excellent stability and cohesion, i.e., connection to the substrate surface, and, on the other hand, allows for a particularly short heating phase.

A further aspect of the present invention is a method for manufacturing a screed plate and/or a tamper bar, more particularly, for a road finisher as described above. The essential feature of the method according to the present invention is the fact that the heating layer is applied to the screed plate and/or the tamper bar by thermal spraying. The first step comprises cleaning of a metallic support plate at least in a region to which a heating layer is to be applied, wherein the support plate forms the underside of a screed plate or a tamper bar. This serves primarily to remove dirt such as oil, grease, etc. In a next step, the cleaned region of the support plate is roughened, in particular, by use of sandblast. Preferred materials for use with the sandblast comprise, in particular, alumina and mixtures comprising alumina and titanium oxide. The preferable roughness to be achieved is in the range of $R_a$=4 to 8 in accordance with the DIN ISO 25178 standard, wherein $R_a$ designates the average roughness. A roughness in the aforementioned range enables optimized cohesion of the coating applied by thermal spraying and, on the other hand, allows for obtaining an insulating layer with reliable insulating properties, i.e., a sufficiently high breakdown voltage. In order to provide a surface with optimized adhesive properties for the heating layer, in a next step, an intermediate anchor layer is applied to the cleaned region of the metallic support plate by thermal spraying to the roughened surface. Subsequently, an electrically insulating layer having the aforementioned properties is applied to the intermediate anchor layer by thermal spraying. In order to prepare the insulating layer for subsequent application of the strip conductor, a mask having recesses corresponding to the desired pattern of the strip conductor is then positioned on the insulating layer. After that, the strip conductor is applied to the insulating layer through said recesses by thermal spraying. Further, if necessary, electrical contacts are placed on the strip conductor to provide for power supply of the strip conductor. Thereafter, the mask is removed from the insulating layer. As a final step, a sealing layer is likewise applied onto the insulating layer and the strip conductor by thermal spraying, whereby the strip conductor is embedded in the sealing layer and the surface of the insulating layer and the strip conductor are sealed against the environment.

BRIEF DESCRIPTION OF THE DRAWINGS

The present invention is described in greater detail below with reference to the exemplary embodiments shown in the figures. In the diagrammatically drawings.

Like components are designated by like reference characters in the figures. Not every component repeated in the figures is identified separately.

DETAILED DESCRIPTION OF THE INVENTION

Figure 1:
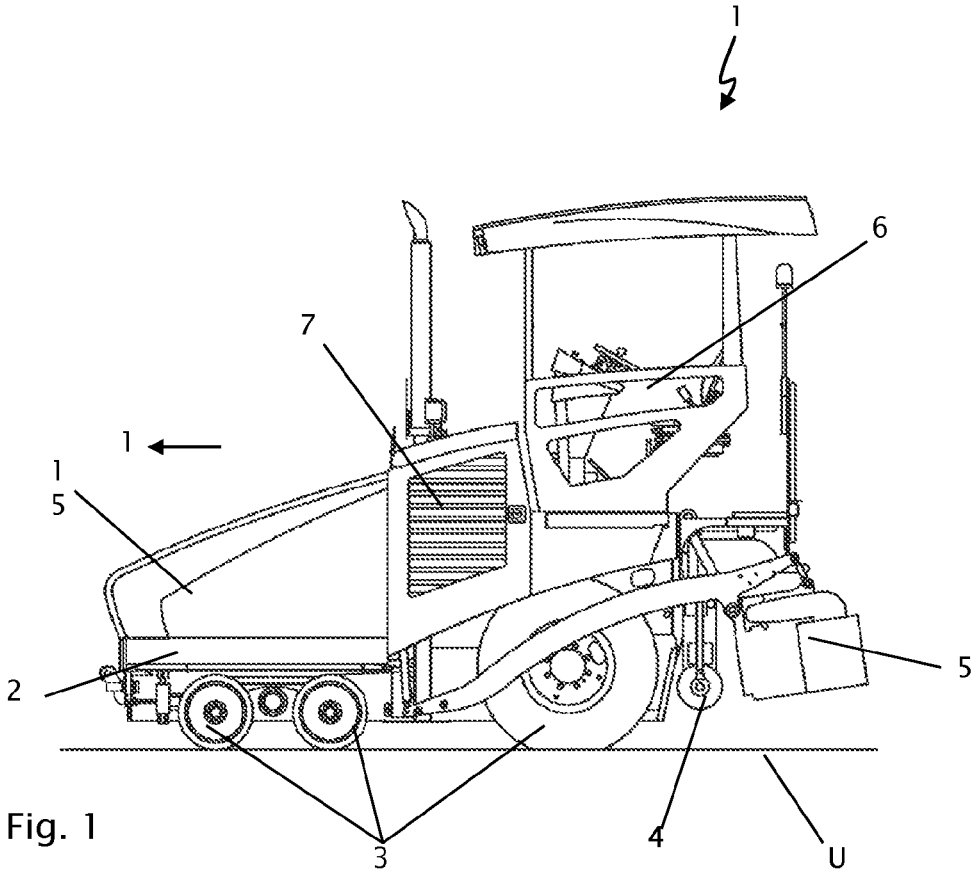
FIG. 1 is a side view of a road finisher.

The essential components of the road finisher 1 are a machine frame 2, driving devices 3 for the traveling operation (track systems can also be used in this context, in part), a bunker 15 for accommodating paving material, a transporting unit (not shown in detail), by means of which the paving material accommodated in the bunker is transported rearwardly contrary to the working direction "a" to the paving section, a spreading screw 4, by means of which the paving material is distributed across the paving width of the road finisher 1 at right angles to the working direction "a", and a paving screed 5 that is trailed after the road finisher 1 during the paving operation in a floating manner on the bituminous paving material. The paving screed is mounted on the road finisher 1 so as to be vertically displaceable and can be lowered from its raised starting position as shown in FIG. 1 towards the road subsurface for execution of the operating mode. Furthermore, a control platform 6 and a drive motor 7 are provided. In the operating mode, the road finisher 1 moves in the working direction "a" and deposits a layer of bituminous paving material of a desired thickness on the road subsurface "U".

Figure 2A:
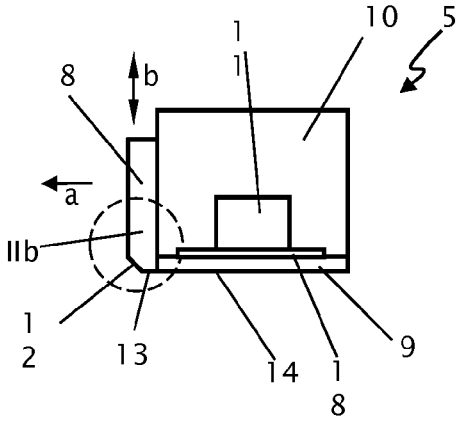
FIG. 2*a* is a side view of a paving screed comprising a tamper bar and a screed plate.

FIG. 2*a* illustrates the essential components of the paving screed. These include a tamper bar 8, a smoothing plate 9 disposed rearwardly of the same in the working direction "a", and a carrier housing 10 comprising an exciter unit 11. The carrier housing 10 and the smoothing plate 9 together form the screed plate. The tamper bar 8 is capable of being moved vertically in the direction of the arrow "b" and thus of carrying out stamping movements in the direction of the arrow "b" during the paving operation. In its front region, the tamper bar 8 comprises an obliquely extending guiding surface (lead-in slope 12) in the working direction followed by a horizontally extending tamping surface 13. The tamper bar 8 is followed by the smoothing plate 9. Above the smoothing plate 9 there is disposed an exciter unit 11 by means of which an oscillating movement can be induced in the paving screed 5. This basic structure of the paving screed 5 is known in the art. The smoothing plate 9 comprises an underside 14 that slides over the paving material and levels the same during the operating mode. The smoothing plate 9 and the part having the lead-in slope 12 are each configured to have a first and a second heating layer 18, 18', respectively, according to the present invention as part of a heating device, the structure and operating mode of which are described in more detail with reference to the subsequent FIGS. 3*a* to 3*e*. The heating device will be described with reference to the exemplary embodiment of the smoothing plate 9 and the tamper bar 8 or its support plate 28. Thus, the embodiments generally illustrated in FIGS. 3*a* to 3*e*, within the scope of the present invention, likewise apply to the screed plate and, in particular, the smoothing plate as well as the tamper bar 8 and, in particular, its support plate 28.

Figure 2B:
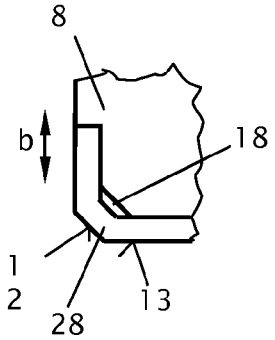
FIG. 2*b* is an enlarged detail of the tamper bar of FIG. 2.

FIG. 2*b* illustrates the enlarged Detail IIb of the tamper bar 8 as shown in FIG. 2*a*. The tamper bar 8 has an L-steel rail 28 comprising a vertical and a horizontal leg and a part with the lead-in slope 12 connecting the two legs. The steel rail or metallic support plate 28 is covering the front edge of the tamper bar 8. Preferably on the back side of the part having lead-in slope 12 there is provided the second heating layer 18'. It is also possible to have a heating layer (not shown) on the back side of the horizontal and/or vertical leg of the tamper bar 8. The term "back side" in each case designates the outside surface facing away from the paving material.

Figure 3A:
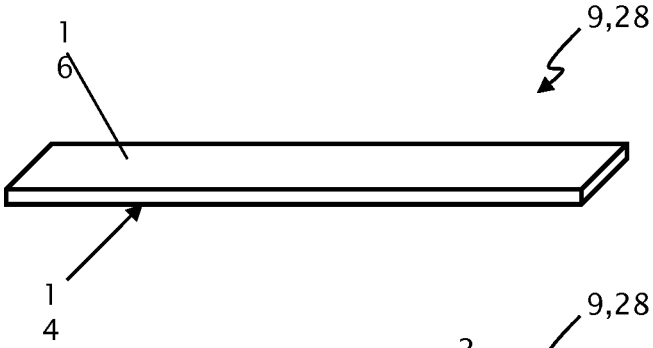
FIG. 3*a* is a perspective oblique view of a smoothing plate of the screed plate or a metallic support plate of the tamper bar as shown in FIG. 2.
Figure 3B:
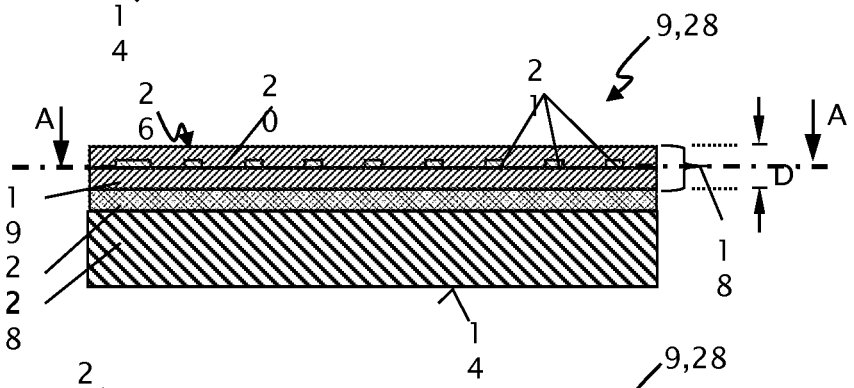
FIG. 3*b* is a vertical cross-sectional view of the smoothing plate or a metallic support plate of the tamper bar of FIG. 2.
Figure 3C:
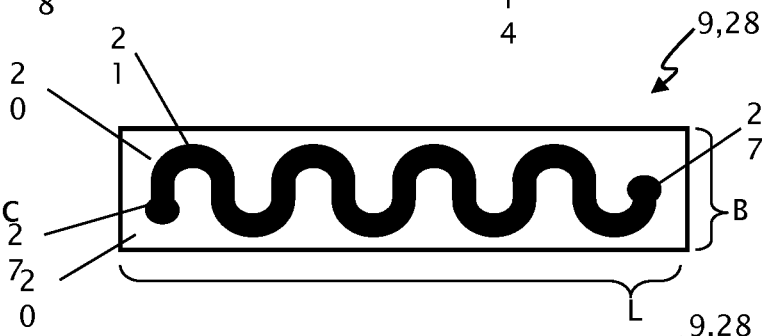
FIG. 3*c* is a horizontal cross-sectional view of the smoothing plate or a metallic support plate of the tamper bar of FIG. 3*b* along the line A-A.

FIGS. 3*a* to 3*c* illustrate the structure of the smoothing plate 9 or the metallic support plate 28 of the tamper bar 8 in greater detail. As shown in FIG. 3*a*, the smoothing plate 9 is a flat member disposed on the underside of the carrier housing 10 of the paving screed 5. The smoothing plate 9 is mounted on the carrier housing 10 by means of its top side 16 and is oriented towards the road subsurface at its underside 14. The smoothing plate 9 is flat over its entire area. The smoothing plate 9 ideally consists of a hardened steel with improved resistance, hardness and toughness, such as, in particular, Hardox. The metallic support plate 28 has the same structure, with three-dimensional shaping, for example, angled structures, not being shown in FIGS. 3*a* to 3*c* for reasons of clarity. Reference is made to FIG. 2*b* in this regard.

Figure 5:
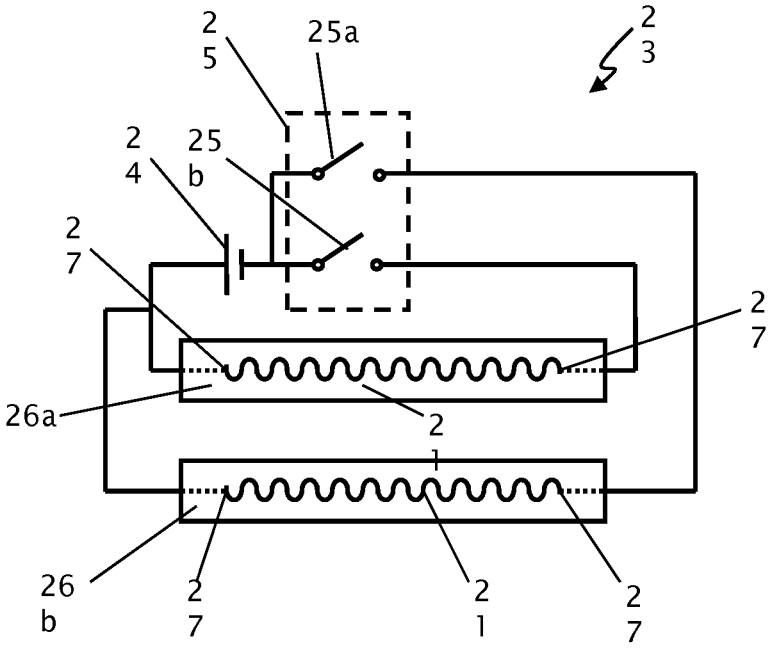
FIG. 5 is a circuit diagram of an electrical heating device comprising two heating elements.

As shown in FIG. 3*b*, the first heating layer 18 of the smoothing plate 9, or the tamper bar 8, is composed of a total of three layers including an electrically insulating layer 19, a sealing layer 20, and a metallic strip conductor 21. Each of these layers has been applied successively and on top of each other by thermal spraying. An intermediate anchor layer 22 is, likewise by thermal spraying, applied directly to the top outside surface (i.e., the outside surface facing away from the paving material, as opposed to the contact surface facing the paving material) which forms the top side of the smoothing plate 9 or the back or inner side of the tamper bar 8. The metallic strip conductor 21 is applied to the surface of the insulating layer 19 facing the sealing layer 20 and is covered by the sealing layer 20. The metallic strip conductor 21 serves as an electrical heating element to heat the sealing layer 20 and forms part of an electric heating circuit which is connected to an electrical power supply system (FIG. 5). The second heating layer 18' of the tamper bar 8 thus has the same composition as the first heating layer 18 of the smoothing plate 9.

The heating layers 18, 18' can be obtained by successively applying the three layers 19, 20 and 21 by means of thermal spraying, in particular, by means of a thermal plasma spraying technique or HVOT, onto the smoothing plate 9 or the tamper bar 8 (more specifically its metallic support plate 28). Any remarks made hereinafter with reference to thermal plasma spraying is to be understood to likewise apply, within the scope of the present invention, to other thermal spraying techniques such as, in particular, HVOT. Thermal plasma spraying technique is a surface coating technology known in the industry. For this purpose in a first step, the intermediate anchor layer 22 is sprayed onto the surface of the smoothing plate 9 or the support plate 28 following preparation of the surface by sand blasting. In particular, a defined surface roughness enables particularly stable, essentially mechanical anchoring of the optional intermediate anchor layer 22 on the smoothing plate 9 or the support plate 28 of the tamper bar 8. Then, the insulating layer 19 is deposited onto the intermediate anchor layer 22 by thermal plasma spraying technique. Next, the strip conductor 21 is deposited on the insulating layer 19 also by thermal plasma spraying technique. Finally, the sealing layer 20 is deposited to seal the insulating layer 19 and the strip conductor 21 from the environment and, in particular, to provide mechanical protection towards the environment. In this specific exemplary embodiment, the strip conductor 21 is deposited on the insulating layer 19 and embedded in the sealing layer 20. Thus, at least three successive steps of the plasma spraying procedure are performed to obtain the first and second heating layer 18 and 18', respectively. The sealing layer 20 and the insulating layer 19 are each composed of alumina based material, whereas the strip conductor 21 is preferably composed, for example, of a nickel-chromium alloy, or of another material composition, in particular, as described above. The heating layer 18 has a thickness "D". The single layers including the insulating layer 19 and the sealing layer 20 are substantially of the same size and of the same thickness, and strip conductor 21 can be of a substantially smaller thickness than, for example, the sealing layer 20.

FIG. 3*c* is a horizontal cross sectional view of the smoothing plate 9 or the metallic support plate of the tamper bar 8 along the line A-A in FIG. 3*b*. FIG. 3*c* illustrates that the strip conductor 21 extends in a meandrous pattern across the surface of the insulating layer 19. When implemented in practice, the strip conductor 21 is not visible on the top side of the smoothing plate or the metallic plate 28 of the tamper bar 8 facing away from the paving material, as it is covered towards the top by the sealing layer 20. Thus, FIG. 3*c* shows the course of the strip conductor 21 as being underneath the sealing layer 20 merely for the purpose of clarification.

The strip conductor 21 terminates at both ends at contact points 27 that are connected to an electrical power supply system, as explained, by way of example, with reference to FIG. 5 below. To this end, provision is made, in particular, for contact pins or comparable connecting means, for example, to lead away from the screed plate 9 or the tamper bar 8.

Figure 3D:
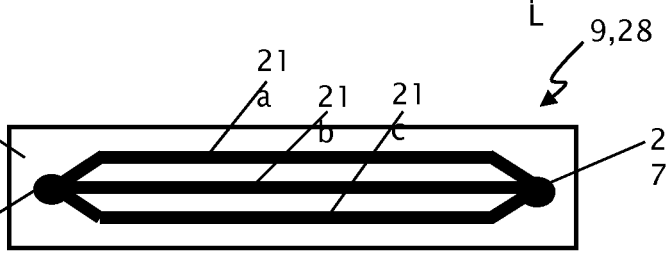
FIG. 3*d* shows an alternative embodiment relating to FIG. 3*c;*
Figure 3E:
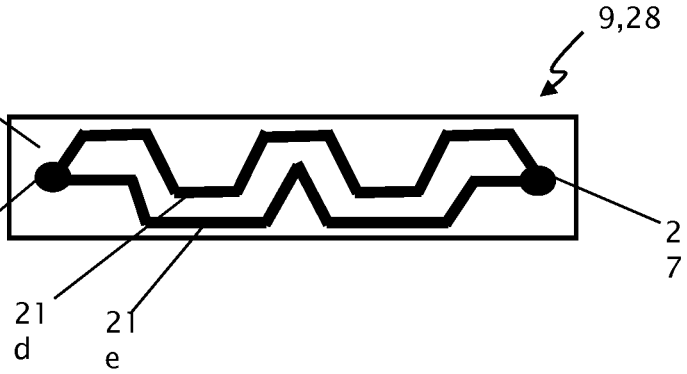
FIG. 3*e* shows a further alternative embodiment relating to FIG. 3*b;*

FIGS. 3*d* and 3*e* show further exemplary embodiments of a possible run of the strip conductor. In FIG. 3*d*, the strip conductor is arranged in a linear pattern of webs across the smoothing plate 9 or the metallic support plate 28 of the tamper bar 8 with a number of individual webs 21*a*, 21*b*, 21*c* running parallel to each other. By contrast, FIG. 3*e* shows two webs 21*d*, 21*e* of the strip conductor that are interested with each other. It is essential for the configuration of the strip conductor that the underside of the smoothing plate 9 or the support plate 28 facing the paving material, apart from heating up rapidly, should also heat up at the same time over its entire surface as far as possible in order to prevent any bituminous paving material from sticking thereto.

Figure 4:
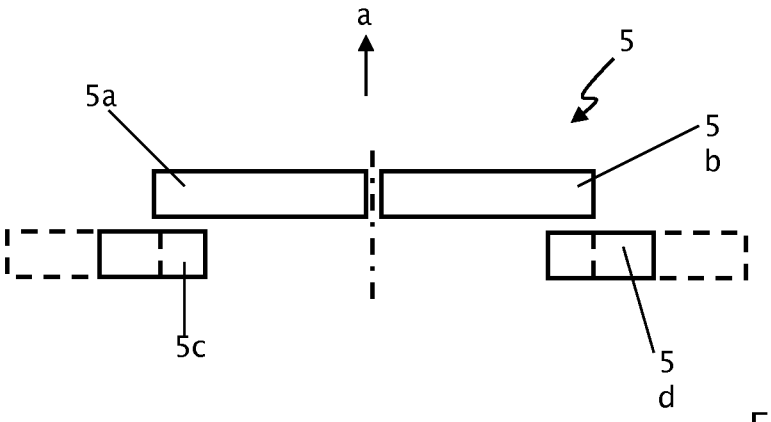
FIG. 4 is a top view of an extendable paving screed.

FIG. 4 shows, by way of example, a bottom view of a paving screed 5, which paving screed 5 comprises a number of elements 5*a* to 5*d*. In addition to the basic elements 5*a* and 5*b*, there are also provided two movable beams 5*c* and 5*d* that are capable of being displaced from an inside position to an outside position, as indicated by the dashed lines, for the purpose of increasing the paving width. In one embodiment of the present invention, provision is made for each of the screed elements 5*a* to 5*d* to comprise a heating layer 18. These heating layers can be operated individually, for example, as shown in more detail by the circuit shown in FIG. 5. Taken as a whole, FIG. 5 shows an electrical heating device 23 consisting of a power source 24, a switchgear unit 25, and the two heating elements 26 (more particularly 26*a* and 26*b*), that are distributed in this case across the screed elements 5*a* and 5*b*, for example. The switchgear unit 25 comprises two individual switches 25*a* and 25*b*, each of which can produce a closed circuit for any one of the two heating elements 26*a* or 26*b*. Thus, the switchgear unit 25 makes it possible to operate any one of the available heating elements individually. In the manner indicated by the circuit shown in FIG. 5, the electrical heating device 23 can of course also be extended almost arbitrarily, as required, to include additional heating elements.

In principle, the basic structure of the heating layer 18 as shown in FIGS. 3*a* to 3*c* can in each case be transferred to the side of the smoothing plate 9 opposite the paving material and, in particular, also to the external surface of the inclined forward ramp 12 and to the compacting region 13 of the tamper bar 8. Both of them can, together or alternatively, be appropriately coated and provided with an electrical heating device 23 as in the above embodiments.

Figure 6:
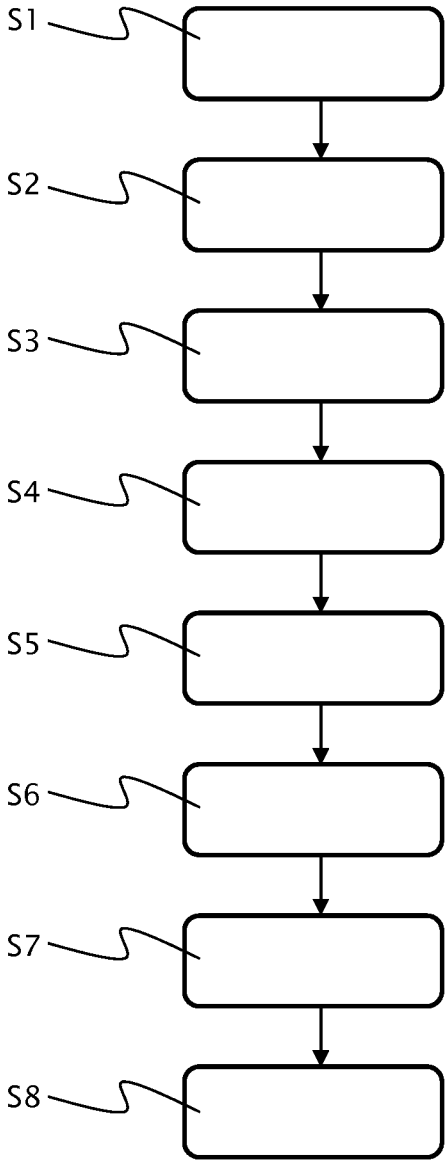
FIG. 6 is a process diagram of the method according to the present invention.

Thus, an essential aspect of the present invention is the fact that the heating element on the smoothing plate 9 and/or on the tamper bar 8 is obtained by thermal spraying. Therefore, no additional adhesive bonding steps are required. FIG. 6 correspondingly summarizes the essential steps of the method. After cleaning (S1) a screed plate or a metallic support plate of a tamper bar at least in a region in which a heating layer is to be applied, wherein the support plate forms the underside of a paving screed or a tamper bar, the screed plate or the support plate is roughened (S2) in said cleaned area, in particular, by sandblasting. Such preparation of the substrate surface enables particularly stable adhesion of an intermediate anchor layer, which in step (S3) is applied to the cleaned and roughened region of the screed plate or the metallic support plate by thermal spraying. In subsequent step (S4) an electrically insulating layer 19 is applied to the intermediate anchor layer, likewise by thermal bonding. In order to prepare the insulating layer for application of the strip conductor, according to the present invention, in step (S5) a mask comprising a recess pattern corresponding to the desired pattern of a strip conductor to be obtained is positioned on the insulating layer. The mask is thus a stencil providing the structure of the strip conductor. In step (S6) the strip conductor is applied to the insulating layer by thermal spraying. After removing (S7) the mask, a sealing layer is applied to the insulating layer and the strip conductor by thermal spraying in a final step (S8), whereby the strip conductor is embedded in the sealing layer and the surfaces of the insulating layer and the strip conductor are sealed against the environment.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A road finisher, comprising:

a screed plate extending at right angles to the working direction (a) of said road finisher; and a tamper bar disposed rearwardly and/or forwardly of said screed plate in the working direction (a), wherein an electrical heating device comprising a power source, at least one electrically operated heating element electrically connected to said power source and a switchgear unit for switching said at least one heating element on and off is present, which is configured so as to heat up a heating surface facing a road subsurface (U), wherein said at least one heating element comprises a heating layer at least partially obtained through thermal spraying onto a substrate surface, and wherein said heating layer is multilayered and comprises at least an insulating layer, a strip conductor and a sealing layer.

2. The road finisher as defined in claim 1, wherein said heating element comprises a heating layer that has been applied to said substrate surface at least partially by plasma spraying or HVOF.

3. The road finisher as defined in claim 1, wherein said heating layer is triple-layered, comprising an insulating layer disposed inwardly on a supporting body, a strip conductor applied to said insulating layer and a sealing layer forming the external surface.

4. The road finisher as defined in claim 1, wherein at least one of said insulating layer or said sealing layer is of alumina based material.

5. The road finisher as defined in claim 1, wherein said strip conductor consists substantially of nickel, chromium or an alloy including both nickel and chromium.

6. The road finisher as defined in claim 1, wherein said strip conductor has a meandrous shape.

7. The road finisher as defined in claim 1, wherein said heating layer is disposed opposite the paving material on the top side of the screed plate.

8. The road finisher as defined in claim 1, wherein said heating layer is disposed opposite the paving material on the top side of said tamper bar.

9. The road finisher as defined in claim 1, wherein said heating layer is applied to at least one of the top side of a screed plate or a tamper bar over an intermediate anchor layer.

10. The road finisher as defined in claim 1, wherein said heating layer has a thickness (D) of approximately 1 mm.

11. A screed plate or a tamper bar comprising a heating layer as defined in claim 1.

12. The road finisher as defined in claim 1, wherein said heating element comprises a heating layer that has been applied to said substrate surface entirely by plasma spraying or HVOF.

13. The road finisher as defined in claim 3, wherein at least one of said insulating layer or said sealing layer is of alumina based material.

14. The road finisher as defined in claim 3, wherein said strip conductor consists substantially of nickel, chromium or an alloy including both nickel and chromium.

15. The road finisher as defined in claim 3, wherein said strip conductor has a meandrous shape.

16. The road finisher as defined in claim 4, wherein said alumina based material comprises alumina with a purity of at least 99.7%.

17. The road finisher as defined in claim 14, wherein said alumina based material comprises alumina with a purity of at least 99.7%.

* * * * *